US008915397B2

(12) United States Patent
Petersen et al.

(10) Patent No.: US 8,915,397 B2
(45) Date of Patent: Dec. 23, 2014

(54) BULK CONTAINER WITH CENTER SUPPORT BETWEEN DROP DOOR AND SIDE WALL

(71) Applicant: Orbis Corporation, Oconomowoc, WI (US)

(72) Inventors: Robert Petersen, Park Ridge, IL (US); Scott Krebs, Hartland, WI (US)

(73) Assignee: Orbis Corporation, Oconomowoc, WI (US)

( * ) Notice: Subject to any disclaimer, the term of this patent is extended or adjusted under 35 U.S.C. 154(b) by 0 days.

(21) Appl. No.: 14/039,767

(22) Filed: Sep. 27, 2013

(65) Prior Publication Data

US 2014/0117035 A1 May 1, 2014

Related U.S. Application Data

(60) Provisional application No. 61/721,240, filed on Nov. 1, 2012.

(51) Int. Cl.
*B65D 51/04* (2006.01)
*B65D 43/16* (2006.01)

(52) U.S. Cl.
CPC ..... *B65D 43/169* (2013.01)
USPC ..... 220/836; 220/4.28; 220/4.29

(58) Field of Classification Search
CPC ..... B65D 43/169
USPC ..... 220/4.22, 4.23, 4.28, 4.29, 6, 7, 810, 220/836, 694; 206/577, 600; 217/12 R, 43 R
See application file for complete search history.

(56) References Cited

U.S. PATENT DOCUMENTS

| | | | | |
|---|---|---|---|---|
| 489,711 | A | 1/1893 | Mandioni | |
| 1,039,452 | A | 9/1912 | Shepard | |
| 1,280,629 | A | 10/1918 | Appleby | |
| 1,381,013 | A | 6/1921 | Rainsford | |
| 2,579,655 | A | 12/1951 | Donald | |
| 3,572,535 | A | 3/1971 | Kinzie | |
| 3,628,683 | A | 12/1971 | Friedrich | |
| 3,692,342 | A * | 9/1972 | Scallan | 292/128 |
| 3,747,794 | A | 7/1973 | Bitney | |
| 3,870,185 | A | 3/1975 | Sanders et al. | |

(Continued)

FOREIGN PATENT DOCUMENTS

| | | |
|---|---|---|
| CA | 2665281 A1 | 11/2009 |
| CN | 200930355382.X | 7/2010 |

(Continued)

OTHER PUBLICATIONS

International Preliminary Report on Patentability for PCT/US08/073306 mailed Feb. 16, 2010.

(Continued)

*Primary Examiner* — Robert J. Hicks
*Assistant Examiner* — Kareen Rush
(74) *Attorney, Agent, or Firm* — Ungaretti & Harris LLP

(57) ABSTRACT

A center support structure between a drop door and a side wall of a bulk bin container is provided. The center support structure can be an extension from a lower portion of the drop door contacting the side wall, or an extension of the side wall contacting a lower portion of the drop door.

20 Claims, 3 Drawing Sheets

(56) References Cited

U.S. PATENT DOCUMENTS 3,874,546 A 4/1975 Sanders et al.
3,924,293 A 12/1975 Cain
3,977,044 A 8/1976 Mort
4,044,910 A 8/1977 Box
4,063,330 A 12/1977 Triplette
4,089,417 A 5/1978 Osborne
4,119,263 A 10/1978 Cuthbertson et al.
4,186,841 A 2/1980 Buckley et al.
4,192,430 A 3/1980 Cornou
4,300,695 A 11/1981 Hsu
4,349,121 A 9/1982 Lafferty
4,454,946 A 6/1984 Yokowo
4,466,541 A 8/1984 Tabler et al.
4,491,231 A 1/1985 Heggeland et al.
4,571,774 A 2/1986 Hinson
4,591,065 A 5/1986 Foy
4,674,647 A 6/1987 Gyenge et al.
4,765,480 A 8/1988 Malmanger
4,775,068 A 10/1988 Reiland et al.
4,798,304 A 1/1989 Rader
4,828,132 A 5/1989 Francis, Jr. et al.
4,863,062 A 9/1989 Holliday
4,917,255 A * 4/1990 Foy et al. ..... 220/6
4,923,079 A 5/1990 Foy
4,967,927 A 11/1990 Reiland et al.
4,987,639 A 1/1991 Baiuley et al.
5,094,356 A 3/1992 Miller
5,114,037 A 5/1992 Hillis et al.
5,150,806 A 9/1992 Glomski
5,199,592 A 4/1993 Reiland et al.
5,289,935 A 3/1994 Hillis et al.
5,398,835 A 3/1995 Blinstrub
5,467,885 A 11/1995 Blinstrub
5,474,197 A 12/1995 Hillis et al.
5,501,353 A 3/1996 Warren
5,535,482 A 7/1996 Grabber
5,538,178 A 7/1996 Zink et al.
5,586,675 A 12/1996 Borsboom et al.
5,632,392 A 5/1997 Oh
D381,513 S 7/1997 Brauner
5,660,291 A 8/1997 Dash
5,673,791 A 10/1997 Jamison
5,711,444 A 1/1998 Meacham et al.
5,725,119 A 3/1998 Bradford et al.
5,769,230 A 6/1998 Koefelda
5,788,103 A 8/1998 Wagner et al.
5,797,508 A 8/1998 Loftus et al.
5,845,799 A 12/1998 Deaton
5,850,935 A 12/1998 Luburic et al.
5,897,012 A 4/1999 Sortwell
5,908,135 A 6/1999 Bradford et al.
5,938,059 A 8/1999 Luburic
5,975,324 A 11/1999 Schmitt
6,000,604 A 12/1999 Lapoint, III
6,015,056 A 1/2000 Overholt et al.
6,029,839 A 2/2000 Mansouri
6,029,840 A 2/2000 Brauner
6,062,410 A 5/2000 Bradford et al.
6,088,239 A 7/2000 Zeiss
6,135,287 A 10/2000 Hartwall
6,138,851 A * 10/2000 Townson ..... 220/6
6,186,932 B1 2/2001 Vallot
6,189,695 B1 2/2001 Ching-rong
6,209,742 B1 4/2001 Overholt et al.
6,223,903 B1 5/2001 Mansouri
6,230,916 B1 5/2001 Bradford et al.
6,243,920 B1 6/2001 Sauve
6,283,319 B1 9/2001 Hillis et al.
6,290,081 B1 9/2001 Merey
6,293,417 B1 9/2001 Varfeldt
6,293,418 B1 9/2001 Ogden et al.
6,305,566 B1 10/2001 Pigott et al.
6,305,726 B1 10/2001 LeTrudet
D452,614 S 1/2002 Overholt
6,386,388 B1 5/2002 Overholt
6,398,054 B1 6/2002 Overholt et al.
6,405,888 B1 6/2002 Overholt et al.
6,416,271 B1 7/2002 Pigott et al.
6,422,409 B2 7/2002 Kofod
6,446,825 B1 9/2002 Godoy
6,460,717 B1 10/2002 Smyers et al.
6,484,898 B2 11/2002 Hillis et al.
RE37,915 E 12/2002 Lapoint, III
6,540,096 B1 4/2003 Bazany et al.
6,543,659 B2 4/2003 Blair
6,601,724 B1 8/2003 Koefelda et al.
6,631,822 B1 10/2003 Overholt
6,669,044 B2 12/2003 Murakami et al.
6,691,885 B2 2/2004 Brown
6,726,046 B2 4/2004 Orset
6,776,300 B2 8/2004 Walsh et al.
6,783,032 B2 8/2004 Fons
6,783,058 B2 8/2004 Quaintance
6,786,394 B2 9/2004 Prince
6,805,254 B2 10/2004 Tanzer et al.
6,820,761 B1 11/2004 Mouri et al.
6,838,616 B2 1/2005 Harrison et al.
6,863,180 B2 3/2005 Apps et al.
6,868,979 B2 3/2005 Rader
6,877,628 B2 4/2005 Nesting
6,899,242 B2 5/2005 Overholt et al.
6,902,061 B1 6/2005 Elstone
6,918,502 B1 7/2005 Overholt et al.
6,955,273 B2 10/2005 Hartwall
6,966,449 B2 11/2005 Williams
7,011,225 B2 3/2006 Oster et al.
7,017,765 B2 3/2006 Overholt
7,017,766 B2 3/2006 Hsu et al.
7,032,765 B2 4/2006 Miller et al.
7,044,319 B2 5/2006 Overholt et al.
7,048,135 B2 5/2006 Smyers et al.
7,059,489 B2 6/2006 Apps et al.
7,063,223 B2 6/2006 Iwahara et al.
7,083,369 B2 8/2006 Nyeboer
7,100,786 B2 9/2006 Smyers
7,104,414 B2 9/2006 Apps et al.
7,128,209 B2 10/2006 Bringard et al.
7,128,231 B2 10/2006 Overholt
7,137,522 B2 11/2006 Dubois
7,159,730 B2 1/2007 Rumpel
7,195,127 B2 3/2007 Hsu et al.
7,258,232 B2 8/2007 Bradford et al.
7,264,122 B2 9/2007 Koefelda et al.
7,287,661 B2 10/2007 Knutsson et al.
7,311,220 B2 12/2007 Kellerer
7,331,480 B1 2/2008 Nolan
7,347,328 B2 3/2008 Hartwall
7,357,269 B2 4/2008 Apps
7,357,271 B2 * 4/2008 Hase et al. ..... 220/592.2
7,370,771 B2 5/2008 Rader
7,416,092 B2 8/2008 Dubois et al.
7,484,634 B2 2/2009 Apps
7,540,390 B2 6/2009 Bublitz et al.
7,774,919 B2 8/2010 Bublitz et al.
7,828,167 B2 * 11/2010 Nolan ..... 220/6
7,861,458 B2 1/2011 Apps et al.
7,861,879 B2 1/2011 Samprathi
8,267,270 B2 9/2012 Samprathi
8,413,831 B2 4/2013 Nolan
8,727,158 B2 * 5/2014 Nolan ..... 220/7
2002/0108950 A1 8/2002 Moorman et al.
2004/0065699 A1 4/2004 Schoer et al.
2004/0084447 A1 5/2004 Dubois
2004/0182858 A1 9/2004 Smyers
2004/0200833 A1 10/2004 Dubois
2004/0256385 A1 12/2004 Hartwall
2005/0098556 A1 5/2005 Kellerer
2005/0103797 A1 5/2005 Rader et al.
2006/0011627 A1 1/2006 Overholt et al.
2006/0091145 A1 5/2006 Miller et al.
2006/0231555 A1 10/2006 Smyers et al.
2006/0237456 A1 10/2006 McDade
2006/0249416 A1 11/2006 Bradford
2007/0029319 A1 2/2007 Speck

(56) References Cited

U.S. PATENT DOCUMENTS

| | | | |
|---|---|---|---|
| 2007/0056967 | A1 | 3/2007 | Dobrinski et al. |
| 2007/0056977 | A1 | 3/2007 | Dobrinski et al. |
| 2007/0068941 | A1 | 3/2007 | Dubois |
| 2007/0075077 | A1 | 4/2007 | Dubois |
| 2007/0095692 | A1 | 5/2007 | Apps |
| 2007/0095842 | A1 | 5/2007 | Apps |
| 2007/0140684 | A1 | 6/2007 | Tsang |
| 2007/0181587 | A1 | 8/2007 | Burnham |
| 2007/0194023 | A1 | 8/2007 | Apps et al. |
| 2007/0272579 | A1 | 11/2007 | Cavalcante |
| 2007/0278223 | A1 | 12/2007 | Ficker |
| 2008/0017638 | A1 | 1/2008 | Bradford |
| 2008/0116199 | A1 | 5/2008 | Bublitz et al. |
| 2008/0116201 | A1 | 5/2008 | Baltz |
| 2008/0169285 | A1* | 7/2008 | Marazita et al. ..... 220/7 |
| 2008/0179322 | A1 | 7/2008 | Parnall et al. |
| 2008/0203089 | A1 | 8/2008 | Hartwall |
| 2009/0044376 | A1 | 2/2009 | Nolan |
| 2009/0152265 | A1 | 6/2009 | Nolan |
| 2009/0266813 | A1 | 10/2009 | Afflerbach et al. |
| 2010/0038331 | A1 | 2/2010 | Ydstrom |
| 2010/0072199 | A1 | 3/2010 | Manuel |
| 2010/0275426 | A1 | 11/2010 | Bublitz et al. |
| 2011/0127275 | A1 | 6/2011 | Dubois |
| 2011/0139775 | A1 | 6/2011 | Nolan |
| 2011/0220643 | A1 | 9/2011 | Van Der Korput et al. |
| 2011/0240639 | A1 | 10/2011 | Nolan |
| 2012/0205369 | A1 | 8/2012 | Nolan |
| 2013/0001225 | A1 | 1/2013 | Samprathi |
| 2014/0042175 | A1 | 2/2014 | Nolan |

FOREIGN PATENT DOCUMENTS

| | | | |
|---|---|---|---|
| CN | 200930355383.4 | | 7/2010 |
| CN | 200930355384.9 | | 7/2010 |
| CN | 201020111642.6 | | 11/2010 |
| CN | 201020145498.8 | | 12/2010 |
| CN | 201020159206.6 | | 12/2010 |
| CN | 201020198781.7 | | 12/2010 |
| CN | 201020132357.2 | | 1/2011 |
| CN | 201020218082.4 | | 1/2011 |
| CN | 201020218085.8 | | 4/2011 |
| CN | 201020169698.7 | | 5/2011 |
| DE | 135488 | C | 11/1933 |
| EP | 0385914 | A1 | 5/1990 |
| EP | 0485672 | A1 | 5/1992 |
| EP | 0785142 | A1 | 7/1997 |
| EP | 0768229 | B1 | 7/1999 |
| EP | 1019293 | B1 | 5/2002 |
| EP | 0737152 | B1 | 8/2002 |
| EP | 1350728 | A2 | 10/2003 |
| EP | 1418130 | A1 | 5/2004 |
| EP | 1427641 | B1 | 6/2004 |
| EP | 1461259 | B1 | 9/2004 |
| EP | 1652646 | A2 | 5/2006 |
| EP | 1440011 | B1 | 6/2006 |
| EP | 1472147 | B1 | 9/2006 |
| EP | 1827942 | A2 | 9/2007 |
| EP | 1927552 | A2 | 6/2008 |
| EP | 1935792 | A1 | 6/2008 |
| EP | 1616803 | B1 | 10/2009 |
| FR | 80400 | E | 10/1961 |
| FR | 2272907 | A1 | 12/1975 |
| GB | 2415689 | A | 1/2006 |
| GB | 2425303 | A | 10/2006 |
| GB | 2426237 | A | 11/2006 |
| GB | 2431921 | A | 5/2007 |
| GB | 2431922 | A | 5/2007 |
| GB | 2438506 | A | 11/2007 |
| GB | 2443949 | A | 5/2008 |
| GB | 2426237 | B | 12/2008 |
| JP | 03381677 | | 12/2002 |
| KR | 1999-0061830 | A | 7/1999 |
| SE | 323908 | B | 5/1970 |
| SE | 522095 | C2 | 1/2004 |
| WO | 9640564 | A1 | 12/1996 |
| WO | 0176960 | A1 | 10/2001 |
| WO | 03024815 | A1 | 3/2003 |
| WO | 03029090 | A1 | 4/2003 |
| WO | 03059763 | A1 | 7/2003 |
| WO | 03074376 | A1 | 9/2003 |
| WO | 03078259 | A1 | 9/2003 |
| WO | 03101846 | A1 | 12/2003 |
| WO | 2004033311 | A2 | 4/2004 |
| WO | 2004080830 | A1 | 9/2004 |
| WO | 2004085779 | A2 | 10/2004 |
| WO | 2004094250 | A1 | 11/2004 |
| WO | 2004101376 | A1 | 11/2004 |
| WO | 2005102852 | A1 | 11/2005 |
| WO | 2006044488 | A2 | 4/2006 |
| WO | 2006062894 | A2 | 6/2006 |
| WO | 2007035464 | A2 | 3/2007 |
| WO | 2007109468 | A2 | 9/2007 |
| WO | 2008033668 | A2 | 3/2008 |
| WO | 2009023830 | A1 | 2/2009 |

OTHER PUBLICATIONS

International Search Report for PCT/US2013/067243 mailed Feb. 7, 2014.

International Search Report for PCT/US08/073306 mailed Nov. 24, 2008.

Written Opinion of International Searching Authority for PCT/US2013/067243 mailed Feb. 7, 2014.

* cited by examiner

BULK CONTAINER WITH CENTER SUPPORT BETWEEN DROP DOOR AND SIDE WALL

CROSS-REFERENCE TO RELATED APPLICATIONS

The present application claims the benefit of U.S. Provisional Application No. 61/721,240 filed Nov. 1, 2012, the contents of which are incorporated herein by reference.

FEDERALLY SPONSORED RESEARCH OR DEVELOPMENT

N/A

FIELD OF THE INVENTION

The present invention generally relates to a bulk bin container having a central support structure between a first hinge and a second hinge connecting a drop door to the side wall of the container.

BACKGROUND OF THE INVENTION

Large plastic bulk bin containers typically are provided with a drop door in one or more of the side walls of the container. The door typically filled a squared off U-shaped opening in the side wall. When upright, the top edge of the door formed part of the top edge of the side wall.

The drop door is connected to the side wall by two or more hinge elements along a bottom edge of the door. Such doors are used to provide access to the interior of the bulk bin. This is particularly useful when access through the top of the bulk bin is restricted, such as when other items (e.g., additional bulk bins, etc.) are stacked on the bulk bin.

In the past, a gap is formed between the drop door and the side wall in the central area between the hinge elements (see e.g., FIG. 3). Loads applied to the top of the bulk bin were transferred primarily to the hinge elements. This could cause bowing, buckling or other displacement of the drop door with respect to the side wall, and/or failure or damage to the hinge elements.

The present bulk container provides improved structure between the door and the side wall designed to overcome some or all of the deficiencies found in prior bulk bin containers.

SUMMARY OF THE INVENTION

The present invention provides a bulk bin container having a central support structure between the hinge elements connecting a drop door to a side wall.

In accordance with one embodiment of the invention, a bulk bin container having support structure between a drop door and a side wall is provided. The bulk bin container comprises a base and a first side wall extending upward from a first side of the base. The first side wall includes a generally rectangular opening. A first drop door is connected to the first side wall by a first articulated hinge and a second articulated hinge spaced from the first articulated hinge. The first drop door fills the opening and forms part of the first side wall when in an upright position. The door exposes the opening when in a collapsed position allowing access to the interior of the container. A central support structure is provided that extends downward from a lower edge of the first drop door between the first articulated hinge and the second articulated hinge. The central support structure is designed to contact an upper edge of the first side wall defining a lower limit of the opening such that loads applied to a top of the drop door are transferred to the first side wall through the central support structure.

The central support structure is designed to prevent the first drop door from moving inward. In this regard, the central support structure can include a first lower portion extending from an exterior side of the drop door and a second upper portion extending from an interior side of the drop door. The side wall can include a lip extending from the interior side of the side wall that contacts a side of the first lower portion to prevent the drop door from moving inwardly.

The central support structure can be an extension of the door that comprises a rib. Alternatively, the extension can comprise two or more ribs.

The first side wall can be hingedly connected to the base. Additionally, the container can comprise a second side wall extending upward from a second side of the base, a third side wall extending upward from a third side of the base, and a fourth side wall extending upward from a fourth side of the base. Each of the second through fourth side walls can also be hingedly connected to the base.

The container can include more than one drop door with a central support structure. In this regard, the container can include a second drop door connected to the second side wall by a first articulated hinge and a second articulated hinge spaced from the first articulated hinge. The second drop door fills the opening and forms part of the second side wall when in an upright position. The door exposes the opening when in a collapsed position. A central support structure extends downward from a lower edge of the second drop door between the first articulated hinge and the second articulated hinge. The central support contacts an upper edge of the second side wall defining a lower limit of the opening such that loads applied to a top of the drop door are transferred to the second side wall through the central support structure of the second drop door.

The central support structure can be a single piece, or it can comprise a first segment and a second segment separated from the first segment by a gap. Similarly, the central support structure can comprise a plurality of segments separated by gaps.

In an alternative embodiment, the support structure can extend upward from the side wall to contact a lower edge of the drop door. In this regard, a bulk bin container is provided that comprises a base, a first side wall extending upward from a first side of the base and including an opening, and a first drop door connected to the first side wall by a first articulated hinge and a second articulated hinge spaced from the first articulated hinge. The first drop door fills the opening and forms part of the first side wall when in an upright position and exposes the opening when in a collapsed position. A central support structure extends upward from an upper edge of the first side wall between the first articulated hinge and the second articulated hinge. The central support contacts a lower edge of the first drop door such that loads applied to a top of the first drop door are transferred to the first side wall through the central support structure.

Further aspects of the invention are disclosed in the Figures, and are described herein.

BRIEF DESCRIPTION OF THE DRAWINGS

To understand the present invention, it will now be described by way of example, with reference to the accompanying drawings in which.

DETAILED DESCRIPTION

Figure 1:
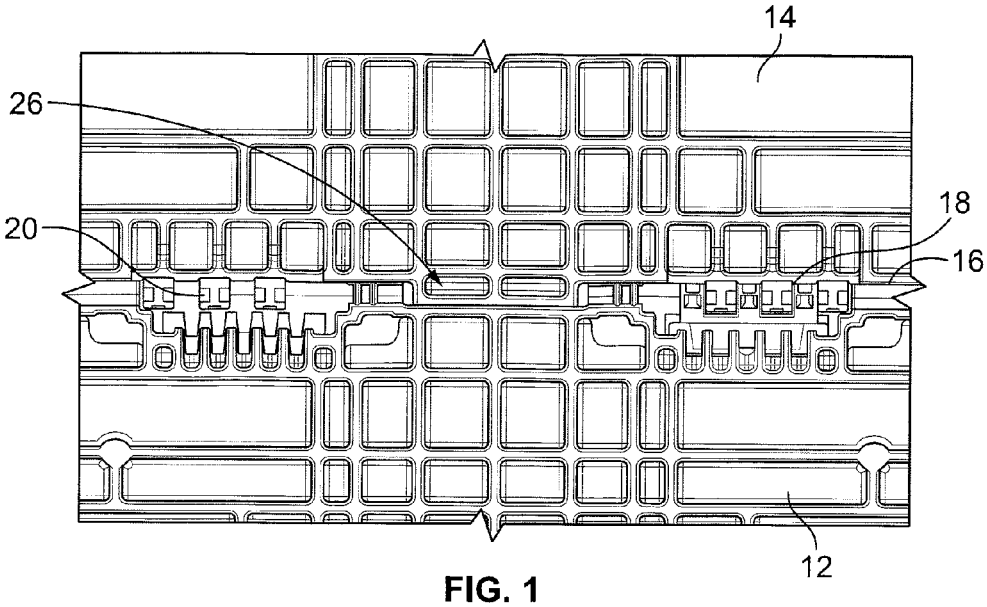
FIG. 1 is a partial view of a drop door hingedly connected to a side wall of a bulk bin container in an upright position having a central extension between the drop door and the side wall in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

Figure 2:
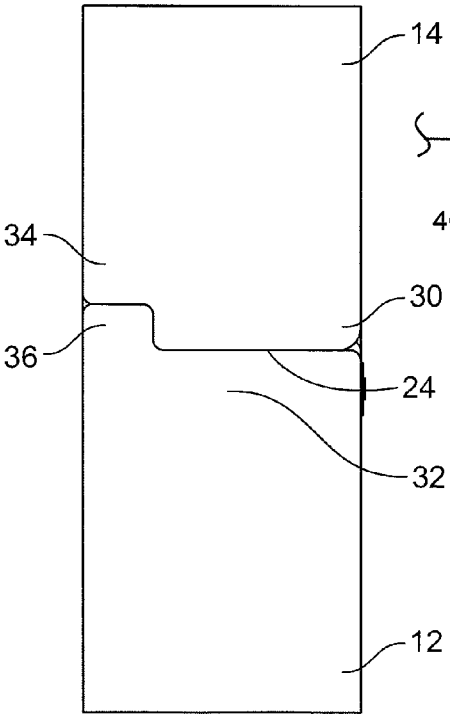
FIG. 2 is a cross-section of the drop door and the side wall of FIG. 1 showing the central extension with the drop door in an upright position.
Figure 7:
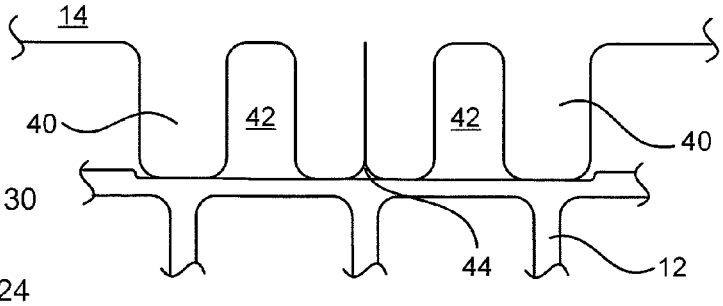
Figure 3:
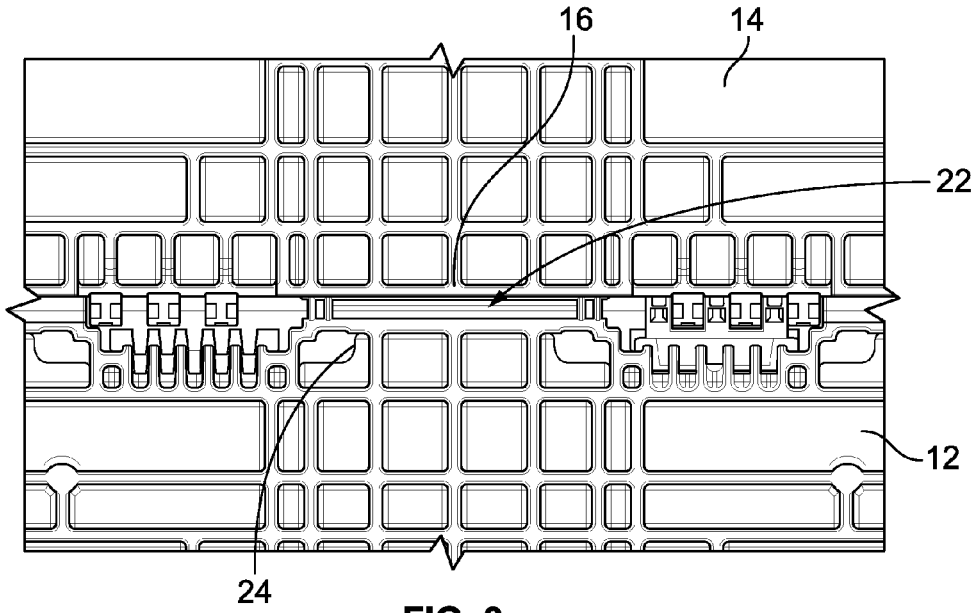
FIG. 3 is a partial view of a drop door hingedly connected to a side wall of a bulk container in an upright position without a central extension.
Figure 4:
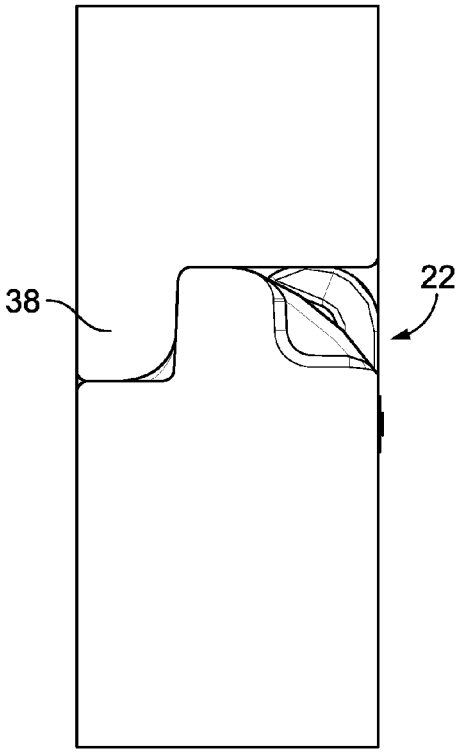
FIG. 4 is a cross-section of the drop door and side wall of FIG. 3.
Figure 6:
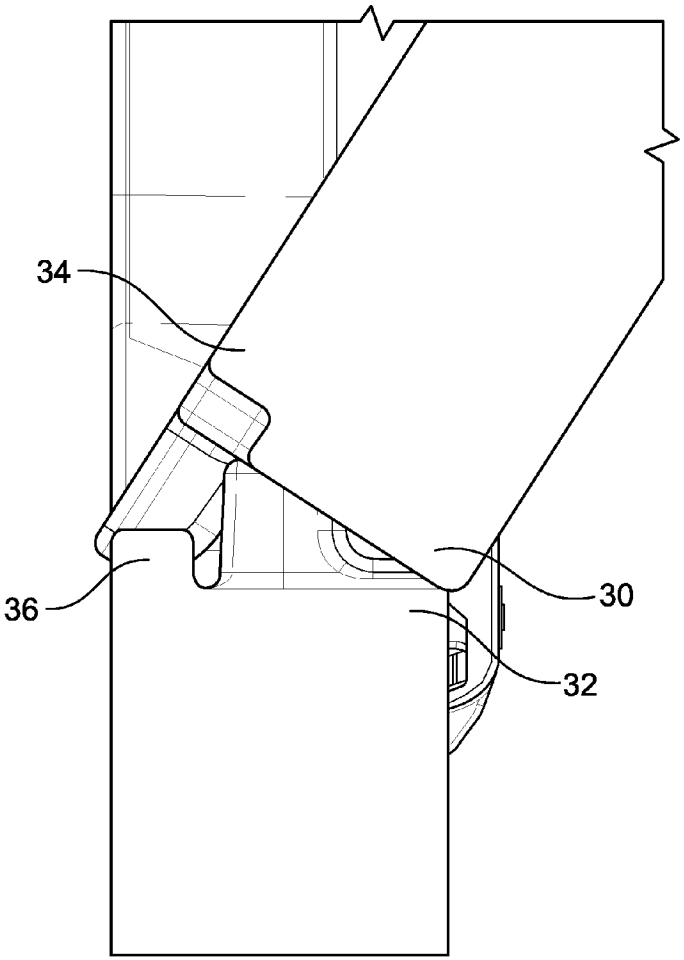
FIG. 6 is a cross-section of the drop door and side wall of FIG. 1 in a partially open position; and, FIG. 7 is a partial view of an alternative support structure.
Figure 5:
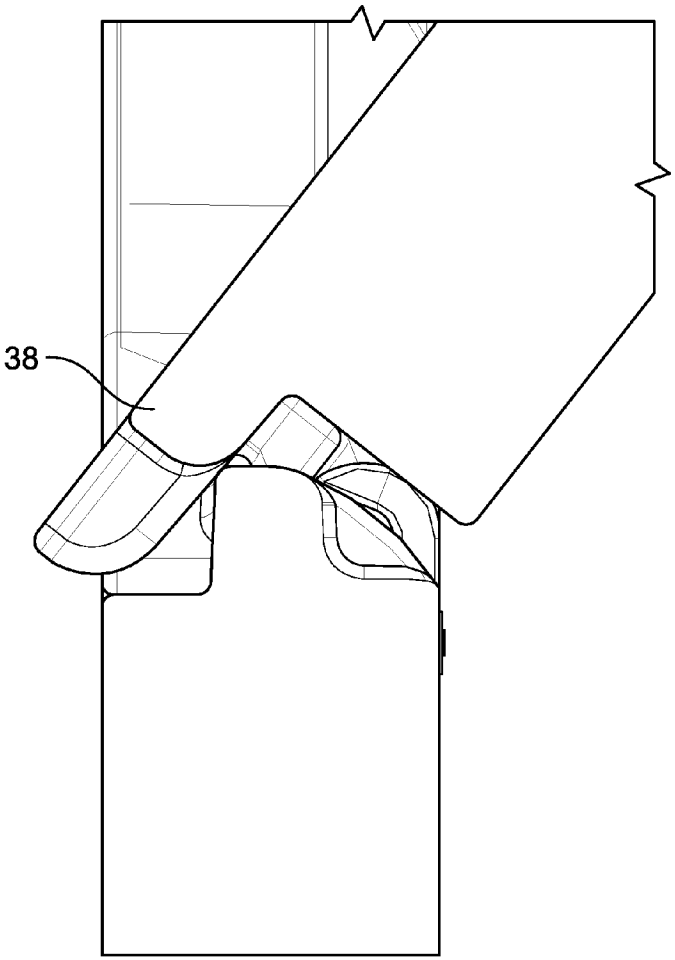
FIG. 5 is a cross-section of the drop door and side wall of FIG. 3 in a partially opened position.

The present invention is directed to an improvement for a bulk container having a drop door in a side wall. Specifically, the drop door is provided with a central extension that contacts the side wall along a bottom edge of the drop door. This allows loads applied to the upper edge of the drop door to be transferred to the side wall and inhibits buckling of the door or undue pressure on the hinge elements. An embodiment of the present invention having the central extension is illustrated in FIGS. 1, 2 and 6. The invention is an improvement over bulk containers without the extension as shown in FIGS. 3, 4 and 5.

Referring to FIG. 1, a partial view of a side wall 12 of a bulk container in accordance with the present invention is shown. The side wall 12 includes a generally rectangular opening for a drop door 14. The bottom edge 16 of the drop door 14 is connected to the side wall 12 by a first articulated hinge 18 and a second articulated hinge 20 spaced from the first articulated hinge 18. Conventional latches (not shown) can be used at the top of the drop door 14 to secure the drop door 14 to the side wall 12 when in an upright position.

The first and second articulated hinges 18, 20 define or border a central portion therebetween. In prior bulk containers, this portion had a gap 22 between the bottom edge 16 of the drop door and an upper edge 24 of the side wall 12 forming a bottom of the opening for the drop door 14 as shown in FIGS. 3, 4 and 5. Loads applied to the top of the drop door 14 in this portion (e.g., by stacking of additional bulk bins or other material) were transferred primarily to the hinge components. The load caused displacement of the drop door 14 in this area (e.g., bowing or sagging) and undue stress on the hinge components.

The present bulk bin includes reinforcing structure to relieve the stress on the hinge components. Referring also to FIG. 2, the drop door 14 includes a lower, centrally located extension 26 positioned between the first articulated hinge 18 and the second articulated hinge 20. The extension 26 is sized to rest on the upper edge 24 of the side wall 12 that defines the lowermost portion of the opening for the drop door 14.

The extension 26 provides a central support structure that fills in the continuous gap 22 found between the hinge elements 18, 20 in prior bulk bins (again, as shown in FIGS. 3, 4 and 5). While the extension 26 is shown as a continuous single piece in FIG. 1, it can be two or more separate sections 40 with gaps 42 or without gaps 44 therebetween.

The extension 26 includes a first lower portion 30 that mates with a lower portion 32 along an exterior of the side wall 12 and an upper portion 34 that mates with a lip 36 on an interior side of the side wall 12 when in the upright position as shown in FIG. 2. It is apparent that any loads applied to the drop door 14 in this area are transmitted directly to the side wall 12.

Known bulk bin container drop door designs, such as that shown in cross-section in FIG. 4, allows a lower lip 38 of the drop door 14 to move inward. In contrast, the present design shown in FIG. 2 prevents the drop door 14 from moving inward. In this regard, the lip 36 abuts the side of the first lower portion 30 and locks the drop door 14 preventing it from moving inward.

FIGS. 5 and 6 show the known and the present designs, respectively, in a partially opened position. Unlike the known design, the central support structure of the present design helps stabilize the door as it rotates.

In an alternative embodiment, the extension can be an upward extension from the upper edge of the side wall 12. In a further alternative embodiment, one or more extensions (whether from the drop door or the side wall) can be formed on the right and/or left side of the central portion (i.e., between one of the first and second hinge elements and the edge of the door or opening).

Many modifications and variations of the present invention are possible in light of the above teachings. It is, therefore, to be understood within the scope of the appended claims the invention may be protected otherwise than as specifically described.

We claim:

1. A bulk container comprising:

a base;

a first side wall extending upward from a first side of the base, the first side wall including an opening;

a first drop door rotatably connected to the first side wall by a first articulated hinge and a second articulated hinge spaced from the first articulated hinge, the first drop door filling the opening and forming part of the first side wall when in an upright position and exposing the opening when in an open position; and a central support structure connected to and extending downward from a lower edge of the first drop door between the first articulated hinge and the second articulated hinge, wherein the central support contacts an upper edge of the first side wall defining a lower limit of the opening such that loads applied to a top of the drop door are transferred to the first side wall through the central support structure when the first drop door is in the upright position, the support structure not contacting the upper edge of the first side wall when the first drop door is in the open position.

2. The bulk container of claim 1 wherein the central support structure prevents the first drop door from moving inward.

3. The bulk container of claim 1 wherein the central support structure comprises a rib.

4. The bulk container of claim 1 wherein the first side wall is hingedly connected to the base.

5. The bulk container of claim 1 further comprising a second side wall Extending upward from a second side of the base, a third side wall extending upward from a third side of the base, and a fourth side wall extending upward from a fourth side of the base.

6. The bulk container of claim 5 further comprising:

a second drop door rotatably connected to the second side wall by a first articulated hinge and a second articulated hinge spaced from the first articulated hinge, the drop door filling the opening and forming part of the second side wall when in an upright position and exposing the opening when in an open position; and a central support structure connected to and extending downward from a lower edge of the second drop door between the first articulated hinge and the second articulated hinge, wherein the central support contacts an upper edge of the second side wall defining a lower limit of the opening such that loads applied to a top of the drop door are transferred to the second side wall through the central support structure of the second drop door when the second drop door is in the upright position, the support structure not contacting the upper edge of the second side wall when the second drop door is in the open position.

7. The bulk container of claim 1 wherein the central support structure comprises a first segment and a second segment separated from the first segment by a gap.

8. The bulk container of claim 1 wherein the central support structure comprises a plurality of segments separated by gaps.

9. The bulk container of claim 1 wherein the central support structure includes a first lower portion extending from an exterior side of the drop door and a second upper portion extending from an interior side of the drop door.

10. The bulk bin container of claim 9 wherein the side wall includes a lip extending from the interior side of the side wall.

11. A bulk container comprising:

a base;

a first side wall extending upward from a first side of the base, the first side wall including an opening;

a first drop door rotatably connected to the first side wall by a first articulated hinge and a second articulated hinge spaced from the first articulated hinge, the first drop door filling the opening and forming part of the first side wall when in an upright position and exposing the opening when in an open position; and a central support structure connected to and extending upward from an upper lower edge of the first side wall between the first articulated hinge and the second articulated hinge, wherein the central support contacts a lower edge of the first drop door such that loads applied to a top of the first drop door are transferred to the first side wall through the central support structure when the first drop door is in the upright position, the support structure not contacting the lower edge of the first drop door when the first drop door is in the open position.

12. The bulk container of claim 11 wherein the central support structure prevents the drop door from moving inward.

13. The bulk container of claim 11 wherein the central support structure comprises a rib.

14. The bulk container of claim 11 wherein the first side wall is hingedly connected to the base.

15. The bulk container of claim 11 further comprising a second side wall extending upward from a second side of the base, a third side wall extending upward from a third side of the base, and a fourth side wall extending upward from a fourth side of the base.

16. The bulk container of claim 15 further comprising:

a second drop door rotatably connected to the second side wall by a first articulated hinge and a second articulated hinge spaced from the first articulated hinge, the second drop door filling the opening and forming part of the second side wall when in an upright position and exposing the opening when in an open position;

a central support structure connected to and extending upward from an upper lower edge of the second side wall between the first articulated hinge and the second articulated hinge, wherein the central support contacts a lower edge of the second drop door such that loads applied to a top of the second drop door are transferred to the second side wall through the central support structure when the second drop door is in the upright position, the support structure not contacting the lower edge of the second drop door when the second drop door is in the open position.

17. The bulk container of claim 11 wherein the central support structure comprises a first portion and a second portion separated from the first portion by a gap.

18. The bulk container of claim 11 wherein the central support structure comprises a plurality of portions separated by gaps.

19. The bulk container of claim 11 wherein the central support structure includes a first upper portion extending from an interior side of the side wall and a second lower portion extending from an exterior side of the side wall.

20. The bulk container of claim 11 wherein the container is made of plastic.

* * * * *

UNITED STATES PATENT AND TRADEMARK OFFICE

CERTIFICATE OF CORRECTION

PATENT NO. : 8,915,397 B2
APPLICATION NO. : 14/039767
DATED : December 23, 2014
INVENTOR(S) : Petersen et al.

It is certified that error appears in the above-identified patent and that said Letters Patent is hereby corrected as shown below:

In the claim

Column 4, line 64, Claim 5, delete “Extending,” and insert --extending-- therefor.

Signed and Sealed this
Twenty-first Day of April, 2015

Michelle K. Lee

Michelle K. Lee
*Director of the United States Patent and Trademark Office*